US007044557B2

(12) United States Patent
Wieland

(10) Patent No.: US 7,044,557 B2
(45) Date of Patent: May 16, 2006

(54) ARTICLE OF READY-TO-ASSEMBLE FURNITURE

(75) Inventor: Blaine L Wieland, Spencerville, IN (US)

(73) Assignee: Home Reserve, Inc., Grabill, IN (US)

( * ) Notice: Subject to any disclaimer, the term of this patent is extended or adjusted under 35 U.S.C. 154(b) by 0 days.

(21) Appl. No.: 10/617,221

(22) Filed: Jul. 10, 2003

(65) Prior Publication Data

US 2005/0006943 A1 Jan. 13, 2005

(51) Int. Cl.
*A47C 4/02* (2006.01)

(52) U.S. Cl. ..... 297/440.1; 297/440.13

(58) Field of Classification Search ..... 297/440.1, 297/440.12, 440.13, 452.4; 248/174; 160/135
See application file for complete search history.

(56) References Cited

U.S. PATENT DOCUMENTS 126,009 A 4/1872 Beidler
2,279,864 A 4/1942 Eide
2,334,912 A 11/1943 Eide
2,364,012 A 11/1944 Walton et al.
2,418,731 A 4/1947 Seitz
2,532,863 A 12/1950 Taylor
2,545,243 A 3/1951 Rumsey, Jr.
2,660,228 A 11/1953 Reinhold
2,692,007 A 10/1954 Christian
2,703,600 A * 3/1955 Harper ..... 297/188.13
2,705,528 A 4/1955 Friedlander
2,705,995 A 4/1955 McMurtry
2,738,834 A 3/1956 Jaffe et al.
3,061,165 A 10/1962 Rench et al.
3,083,889 A 4/1963 Christensson
3,132,910 A 5/1964 Vigna
3,316,018 A * 4/1967 Stith ..... 297/440.1
3,458,996 A 8/1969 Dunbar et al.
3,467,433 A 9/1969 Lindau et al.
3,540,776 A 11/1970 Wilson
3,584,916 A * 6/1971 Bayes ..... 297/232
3,594,056 A 7/1971 Sager
3,643,997 A 2/1972 Gilbert et al.
3,680,916 A 8/1972 Gilbert et al.
3,704,911 A 12/1972 Milakovich
3,747,743 A 7/1973 Hoffman, Jr.
3,870,366 A * 3/1975 Rogers ..... 297/440.23
3,951,558 A 4/1976 Komarov
4,030,846 A 6/1977 Flototto (Continued)

*Primary Examiner*—Peter R. Brown
(74) *Attorney, Agent, or Firm*—Baker & Daniels LLP

(57) ABSTRACT

The present invention provides fully upholstered, ready-to-assemble furniture which may be custom ordered by a purchaser, shipped directly to the home of the purchaser by a parcel delivery service, and then easily and quickly assembled by the purchaser. The ready-to-assemble article of furniture includes a frame having a composite frame member with a long dimension which is formed by a plurality of planar frame members assembled in an end-to-end and overlapping manner. The plurality of planar frame members are interconnected by interlocking protrusions and cutout portions, as well as by threaded fasteners received in push-in connector elements which are held in recesses within the frame members. The interlocking and threaded fastener connections allow a plurality of smaller frame members to form the composite frame member of the furniture frame, wherein the frame has the torsional and longitudinal stability of known furniture frames which include long, single boards. In particular, the interlocking and overlapping structure of the present furniture frame advantageously provides longitudinal and torsional stability to an article of furniture having a long dimension such as an entertainment center or sofa.

10 Claims, 10 Drawing Sheets

U.S. PATENT DOCUMENTS 4,055,924 A 11/1977 Beaver, Jr.
4,078,842 A 3/1978 Zur
4,140,065 A 2/1979 Chacon
4,184,608 A 1/1980 Christensson
4,280,269 A 7/1981 Marini
4,340,251 A * 7/1982 Geoffroy-Dechaume ..... 297/440.12
4,418,514 A 12/1983 Spann
4,438,603 A * 3/1984 Durkan, Jr. ..... 297/232
4,466,675 A 8/1984 Ferdinand et al.
4,521,928 A 6/1985 Stephenson
4,575,886 A 3/1986 Larson
4,577,816 A 3/1986 Foster
4,593,950 A 6/1986 Invanti
4,601,621 A 7/1986 Permoda
4,675,929 A 6/1987 Santo
4,679,260 A 7/1987 Frettem
4,697,847 A 10/1987 Herschlag
4,788,727 A 12/1988 Liu
4,828,324 A 5/1989 Putnam
4,841,586 A 6/1989 Juster et al.
4,848,839 A 7/1989 Galardo
4,869,564 A 9/1989 Lechman
4,879,775 A 11/1989 Keefer
4,881,779 A 11/1989 Bubien
4,883,317 A 11/1989 Davenport
4,886,326 A 12/1989 Kuzyk
4,925,245 A 5/1990 Pendleton et al.
4,928,337 A 5/1990 Chauncey
5,112,110 A 5/1992 Perkins
5,115,526 A 5/1992 Boyd
5,263,764 A 11/1993 Laughlin et al.
5,338,095 A 8/1994 Laughlin et al.
5,415,461 A 5/1995 Sakamoto
5,423,597 A * 6/1995 Rogers ..... 297/440.1
5,487,690 A * 1/1996 Stoffle et al. ..... 160/135
5,536,078 A 7/1996 Novikoff
5,546,718 A * 8/1996 Way ..... 160/135
5,622,030 A 4/1997 Steed et al.
5,671,492 A 9/1997 Simon
5,678,897 A 10/1997 Prestia
5,878,470 A 3/1999 Blansett
6,000,079 A 12/1999 Dranger
6,105,654 A * 8/2000 Martel ..... 160/135
6,109,329 A * 8/2000 Russo ..... 160/135
6,241,317 B1 6/2001 Wu
6,267,446 B1 7/2001 Wieland et al.
6,279,997 B1 * 8/2001 Moore et al. ..... 297/440.1
6,568,058 B1 5/2003 Wieland et al.
6,688,699 B1 * 2/2004 Bowie ..... 297/440.14
2003/0056907 A1 * 3/2003 Caveney et al. ..... 160/135

* cited by examiner

ARTICLE OF READY-TO-ASSEMBLE FURNITURE

BACKGROUND OF THE INVENTION

1. Field of the Invention

The present invention relates generally to custom ordered furniture and the construction and packaging of such furniture for shipment and storage. More particularly, the invention relates to fully upholstered, ready-to-assemble furniture which may be custom ordered by a consumer, packaged by the seller for shipment to the consumer by a parcel delivery service, and then assembled by the consumer from the packaged components.

2. Description of the Related Art

Ready-to-assemble furniture is furniture which is packaged for shipment and storage in disassembled form, with assembly to be done by the consumer or end user. Examples of existing ready-to-assemble non-upholstered furniture include bookcases, television stands, and simple chairs and benches. Mass merchandized, ready-to-assemble furniture is expected to be rather less expensive to the consumer than comparable pre-assembled furniture or to have distinctive functional features generally not available with its pre-assembled counterpart.

The genre of ready-to-assemble furniture packaged for mass merchandizing sale and home delivery has generally been limited to pieces of furniture which are utilitarian or hard-surfaced. Additionally, when a piece of furniture includes a long dimension, such as the side walls of a tall entertainment center or the front and rear walls of a sofa, it is limited in a shipping capacity by the long straight boards involved in its construction, such that the article of furniture cannot be shipped by a parcel delivery service without incurring additional and expensive charges. For instance, United Parcel Service, Inc. (UPS) presently has shipping limits that, when exceeded, subject the retailer or consumer to additional charges for "particularized delivery." Specifically, for less expensive non-particularized delivery, packages should only weigh up to 150 pounds, should only be up to 130 inches in length and girth combined, and should only be up to 108 inches in length. Also, packages cannot have any side over 60 inches in length without incurring additional charges. Oversize packages containing furniture with a long dimension (over 108 inches in length or part of a length and girth combination of over 130 inches in length) require special pricing and dimensional weight calculations.

The special pricing not only adds cost to the furniture, but it also delays shipping times and forces the consumer to wait longer for delivery of the furniture. As such, prior ready-to-assemble furniture does not satisfy the need for fully upholstered or other types of ready-to-assemble furniture having a long dimension which may be custom ordered by the consumer and delivered to the household of the consumer by a parcel delivery service using non-particularized delivery.

What is needed is ready-to-assemble furniture of high quality and stable construction which may be packaged in a compact, easily storable and transportable manner, for easy shipment via existing, non-particularized home delivery channels.

SUMMARY OF THE INVENTION

The present invention provides fully upholstered, ready-to-assemble furniture which may be custom ordered by a purchaser, shipped directly to the home of the purchaser by a parcel delivery service, and then easily and quickly assembled by the purchaser. The ready-to-assemble article of furniture includes a frame having a composite frame member with a long dimension which is formed by a plurality of planar frame members assembled in an end-to-end and overlapping manner. The plurality of planar frame members are interconnected by interlocking protrusions and cutout portions, as well as by threaded fasteners received in push-in connector elements which are held in recesses within the frame members. The interlocking and threaded fastener connections allow a plurality of smaller frame members to form the composite frame member of the furniture frame, wherein the frame has the torsional and longitudinal stability of known furniture frames which include long, single boards. In particular, the interlocking and overlapping structure of the present furniture frame advantageously provides longitudinal and torsional stability to an article of furniture having a long dimension such as an entertainment center or sofa.

The plurality of planar frame members are of a suitable size so they may be packaged for non-particularized parcel delivery service. Non-particularized delivery reduces the cost of shipping the furniture and decreases the amount of time the consumer must wait for delivery. Further, the compact packaging gives consumers the option of taking the furniture home from a retail location at the time of sale in their own vehicles, rather than requiring them to wait for particularized delivery by the retailer or another carrier.

Conventional pre-assembled upholstered furniture can be generally classified as having high quality and high cost, or low quality and low cost. The present invention provides ready-to-assemble upholstered furniture of high quality and low cost. In addition, the above advantages enable the novel approach to the sale of fully upholstered furniture involving the custom ordering of furniture by a consumer over an Internet website for quick home, non-particularized, delivery by a parcel delivery service, such as, e.g., UPS.

In one embodiment, an article of furniture is provided, including a frame having a plurality of planar frame members connected to one another, the frame having at least one composite frame member, the composite frame member including at least two frame members coupled to one another in an end-to-end manner.

In another embodiment, an article of furniture is provided including a frame having a plurality of planar frame members connected to one another, the frame including a front wall and a rear wall, at least one of the front wall and the rear wall having a composite frame member, the composite frame member including at least three of the frame members coupled to one another in an end-to-end manner.

In a further embodiment, an article of seating furniture is provided including a frame having a composite frame member, the frame including a seat portion, a backrest portion, a front wall, and a rear wall, at least one of the front wall and the rear wall having a composite frame member, the composite frame member including a plurality of separate planar frame members coupled to one another in an end-to-end manner.

A still further embodiment provides a method of assembling an article of furniture which includes a composite frame member having a long dimension, including the steps of providing a disassembled frame having a plurality of planar frame members, and coupling at least two of the frame members to one another in an end-to-end manner, with the frame members extending along the long dimension of the composite frame member.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION

Figure 1:
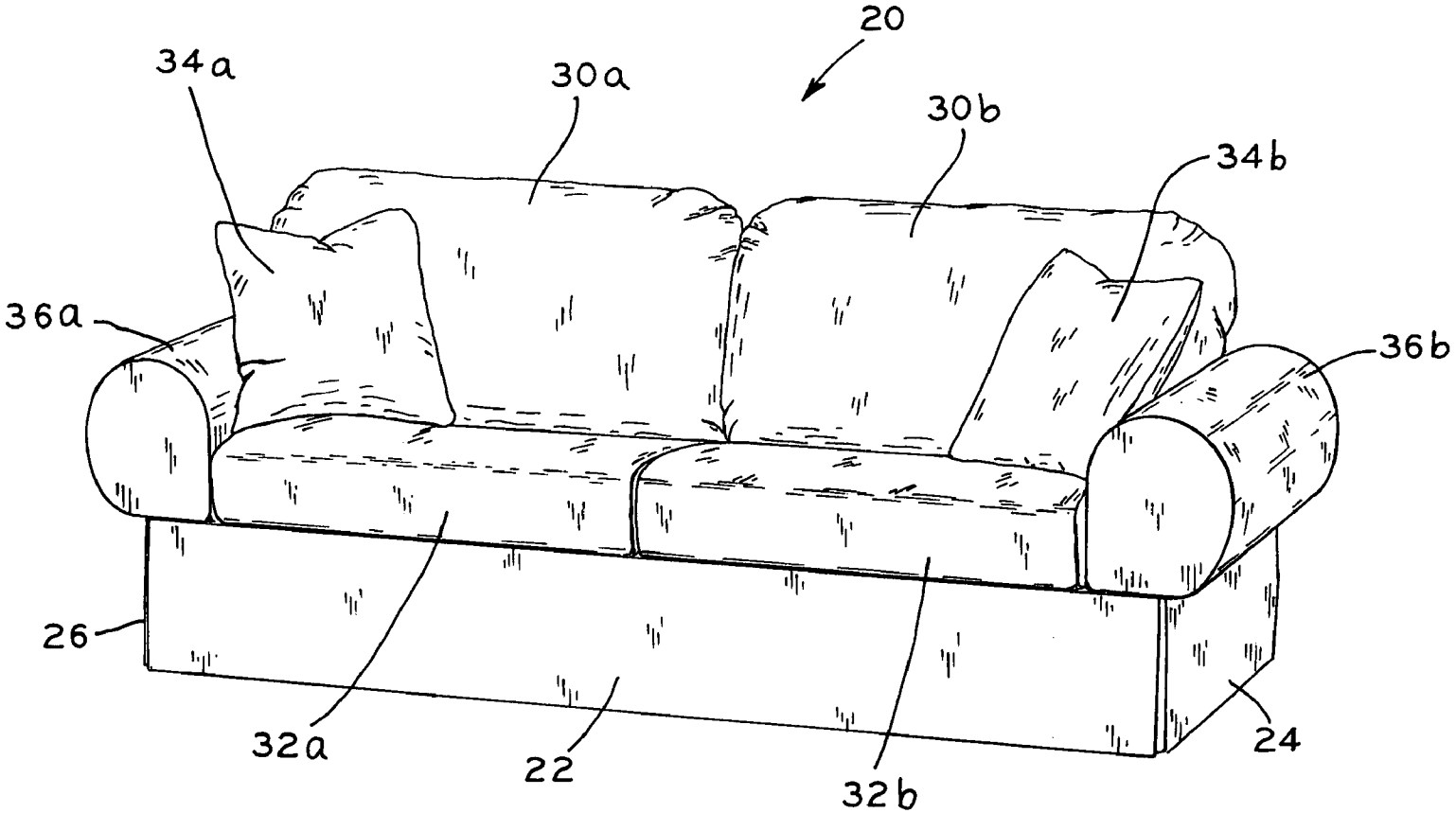
FIG. 1 is a perspective view of an assembled exemplary article of furniture according to the present invention, shown as a sofa.

Referring now to the drawings and in particular FIG. 1, article of furniture 20 is shown as a sofa. Except as described below, article of furniture 20 includes many features similar to the article of furniture described in U.S. Pat. No. 6,568,058, entitled FULLY UPHOLSTERED, READY-TO-ASSEMBLE ARTICLE OF FURNITURE, assigned to the assignee of the present invention, the disclosure of which is expressly incorporated herein by reference. Article of furniture 20 includes front wall 22, rear wall 28 (FIGS. 2 and 3), and side walls 24 and 26. Article of furniture 20 further includes back cushions 30*a* and 30*b*, seat cushions 32*a* and 32*b*, arm cushions 36*a* and 36*b*, and optionally, pillows 34*a* and 34*b*. Each of back cushions 30*a* and 30*b*, seat cushions 32*a* and 32*b*, arm cushions 36*a* and 36*b*, and pillows 34*a* and 34*b* include an upholstery cover enclosing a foam pad or a pillow. Although shown as a sofa in FIG. 1, the present invention may encompass other articles of furniture including, i.e., an entertainment center, a bookcase, or a computer workstation and desk, for example.

Figure 2:
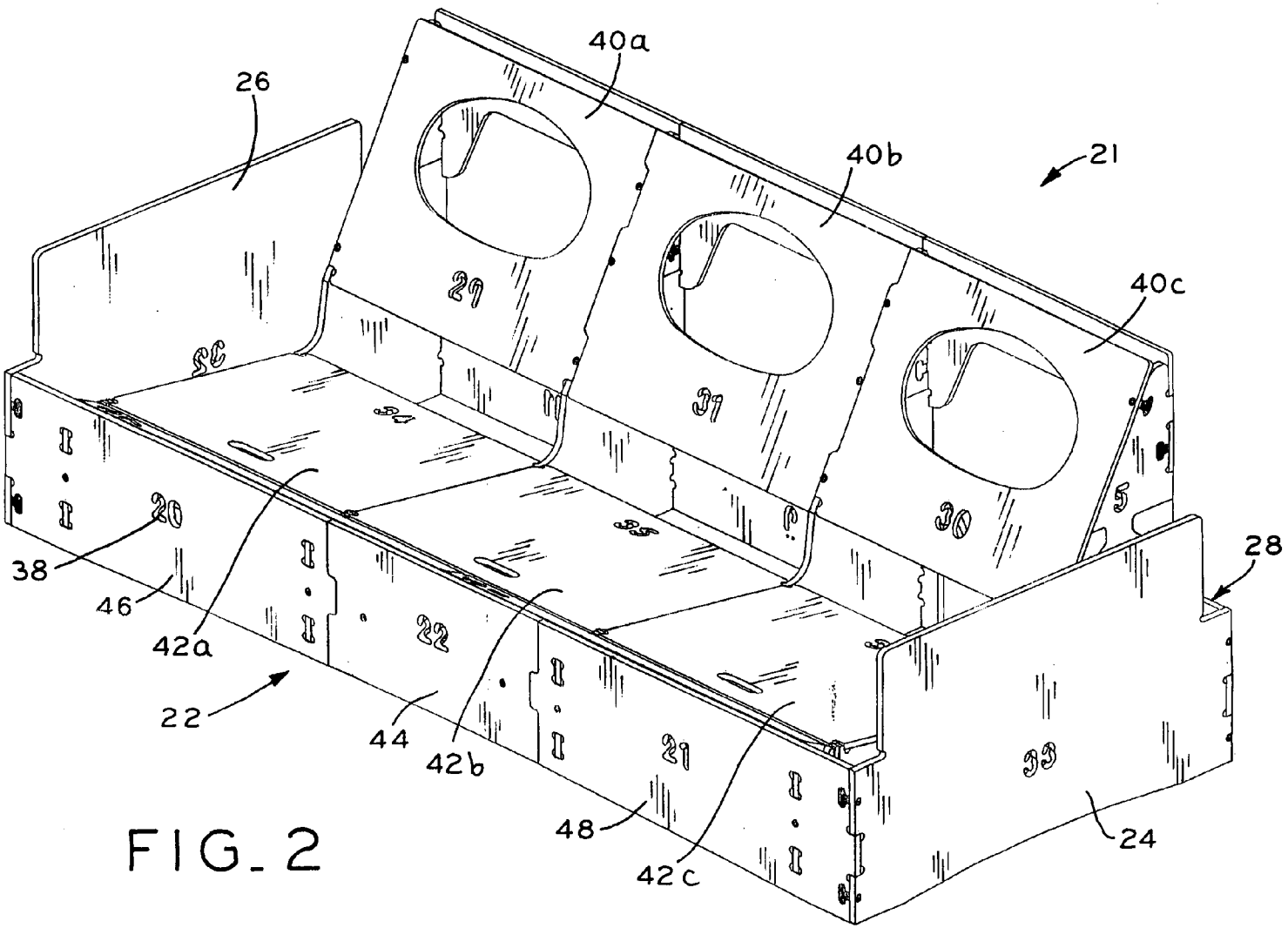
FIG. 2 is a front perspective view of the assembled frame of the sofa of FIG. 1.
Figure 3:
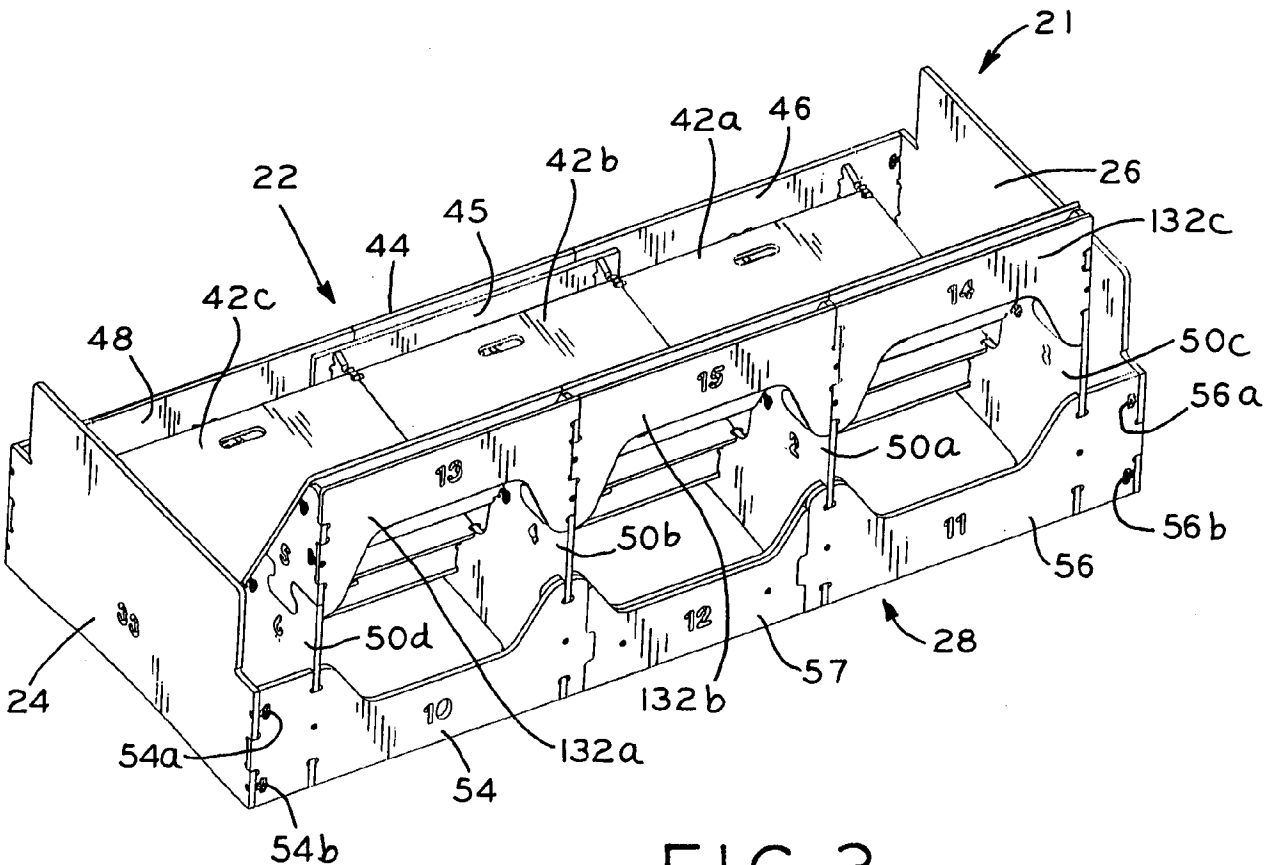
FIG. 3 is a rear perspective view of the assembled frame of the sofa of FIG. 1.

Frame 21 of article of furniture 20 is shown in FIGS. 2 and 3. Cutout numbers 38 are provided in each frame member of frame 21 for assistance in the assembly process, and are unrelated to the reference numerals used in the present description herein. Advantageously, this numbering of frame members eases assembly of frame 21 by allowing the individual frame members to be identified and referred to in a set of printed assembly instructions, for example. Front wall 22 of article of furniture 20 includes end frame members 46 and 48, covering frame member 44, and central frame member 45 (FIG. 3) disposed behind covering frame member 44, the interconnection and structure of which will be described further below with reference to FIGS. 9–13. Frame 21, as shown in FIG. 2, further includes back rest portions 40*a*, 40*b* and 40*c* providing a backrest for a user as well as a back support for back cushions 30*a* and 30*b*, and seat portions 42*a*, 42*b* and 42*c* providing a seating surface and a seat support for seat cushions 32*a* and 32*b*. Seat portions 42*a*, 42*b* and 42*c* also provide storage compartments within frame 21. Frame 21, as shown in FIG. 3, further includes frame members 132*a*, 132*b* and 132*c* added to increase the stability and strength of article of furniture 20. Furthermore, side walls 24 and 26 provide an armrest for a user and also support arm cushions 36*a* and 36*b*. Frame 21 further includes rear wall 28, shown in FIG. 4, which will be further described below with reference to FIGS. 4–8.

Figures 4, 5:
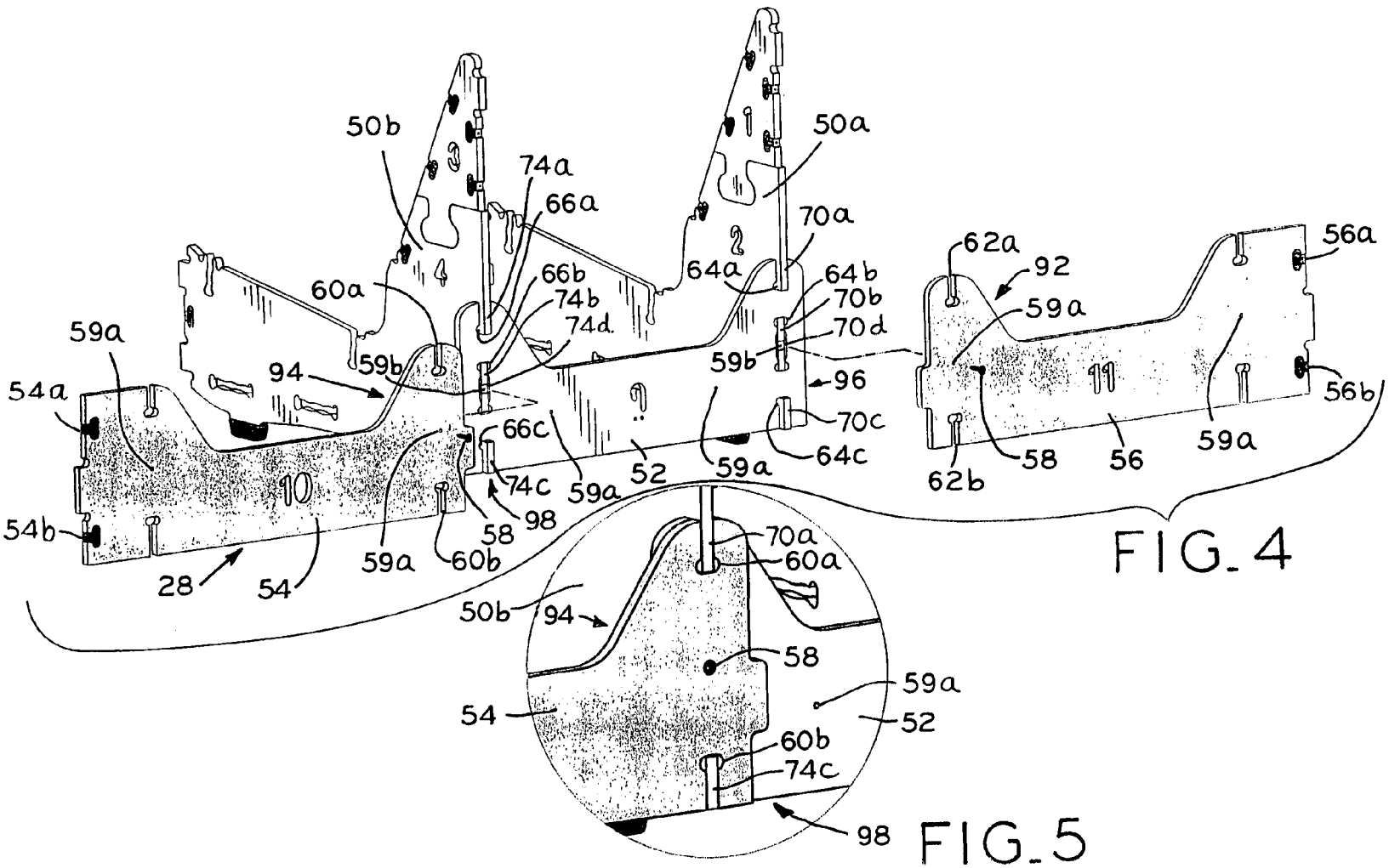
FIG. 4 is an exploded partial perspective view of a portion of the frame of FIG. 3, showing the attachment of individual planar frame members according to the initial assembly steps.
FIG. 5 is a perspective view of a portion of the frame of FIG. 4, showing the interlocking and threaded fastener connections of the individual planar frame members.
Figure 6:
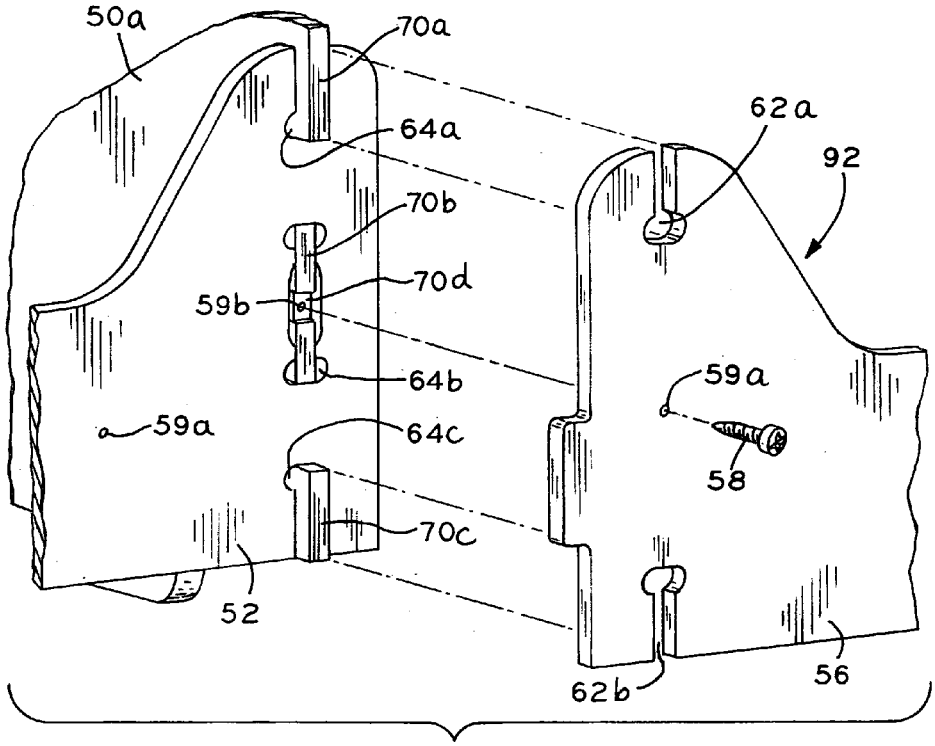
FIG. 6 is an exploded partial perspective view of a portion of the frame of FIG. 4, showing the attachment of individual planar frame members according to the assembly steps.

The structure and construction of rear wall 28 will be described with reference to FIGS. 4–8. Perpendicular members 50*a* and 50*b*, shown in FIG. 4, are connected to central frame member 52 using a plurality of interlocking connections and threaded fasteners. Central frame member 52 includes recesses or slots 64*a*, 64*b* and 64*c* on its first end portion 96, and recesses or slots 66*a*, 66*b* and 66*c* on its opposite end portion 98. Central frame member 52 further includes fastener holes 59*a* operable to receive threaded fasteners 58. Perpendicular member 50*a* includes protrusions 70*a*, 70*b* and 70*c*, and perpendicular member 50*b* includes protrusions 74*a*, 74*b* and 74*c*. Recesses 64*a*, 64*b* and 64*c* of central frame member 52 engage with protrusions 70*a*, 70*b* and 70*c*, respectively, of perpendicular member 50*a* to provide an interlocking connection therebetween. Protrusions 70*a* and 70*c* each extend beyond the planar surface of central frame member 52, while protrusion 70*b* is flush with the surface of central frame member 52. Protrusion 70*b* includes a recess adapted to receive push-in connector element 70*d* including connector fastener hole 59*b*, as shown in FIG. 6. As described in detail in the above-incorporated U.S. Pat. No. 6,568,058, push-in connector element 70*d* may be formed of any suitable plastic and receives threaded fastener 58 in connector fastener hole 59*b*. Push-in connector element 70*d* provides a secure connection between perpendicular member 50*a* and end frame member 56 when threaded fastener 58 is inserted through hole 59*a* in end frame member 56 and tapped into hole 59*b* of connector element 70*d*. Protrusions 74*a*, 74*b* and 74*c* of perpendicular member 50*b* engage with recesses 66*a*, 66*b* and 66*c*, respectively, of central frame member 52. Protrusions 74*a* and 74*c* extend beyond the planar surface of central frame member 52, while protrusion 74*b* includes push-in connector element 74*d* having connector fastener hole 59*b* and is flush with the surface of central frame member 52.

Referring to FIGS. 4–5, end frame member 54 of rear wall 28 includes recesses 60*a* and 60*b* in engagement with protrusions 74*a* and 74*c*, respectively, of perpendicular member 50*b*, and includes fastener holes 59*a*. When connected, protrusions 74*a* and 74*c* are flush with the surface of end frame member 54. End frame member 54 is secured further to perpendicular member 50*b* via threaded fastener 58 inserted through fastener hole 59*a* of end frame member 54 and threaded into connector fastener hole 59*b* of push-in connector element 74*d*, as shown in FIG. 5. End frame member 56 includes recesses or slots 62*a* and 62*b*, as well as fastener holes 59*a*. Recesses 62*a* and 62*b* engage with protrusions 70*a* and 70*c*, respectively, of perpendicular member 50*a* to form an interlocking connection therewith, as shown in FIG. 4. End frame member 56 is further secured to perpendicular member 50*a* via threaded fastener 58 threaded through one fastener hole 59*a* in end frame member 56 and connector fastener hole 59*b* of push-in connector element 70*d*.

End frame member 54 includes end portion 94 overlapping end portion 98 of central frame member 52 and end frame member 56 includes end portion 92 overlapping end portion 96 of central frame member 52, as shown in FIG. 4. The interlocking and overlapping connections formed by end frame members 54 and 56 with central frame member 52 provide longitudinal and torsional stability to frame 21 when fully assembled, which is equivalent to the longitudinal and torsional stability provided by a single long board in a known article of furniture.

Figures 7, 8:
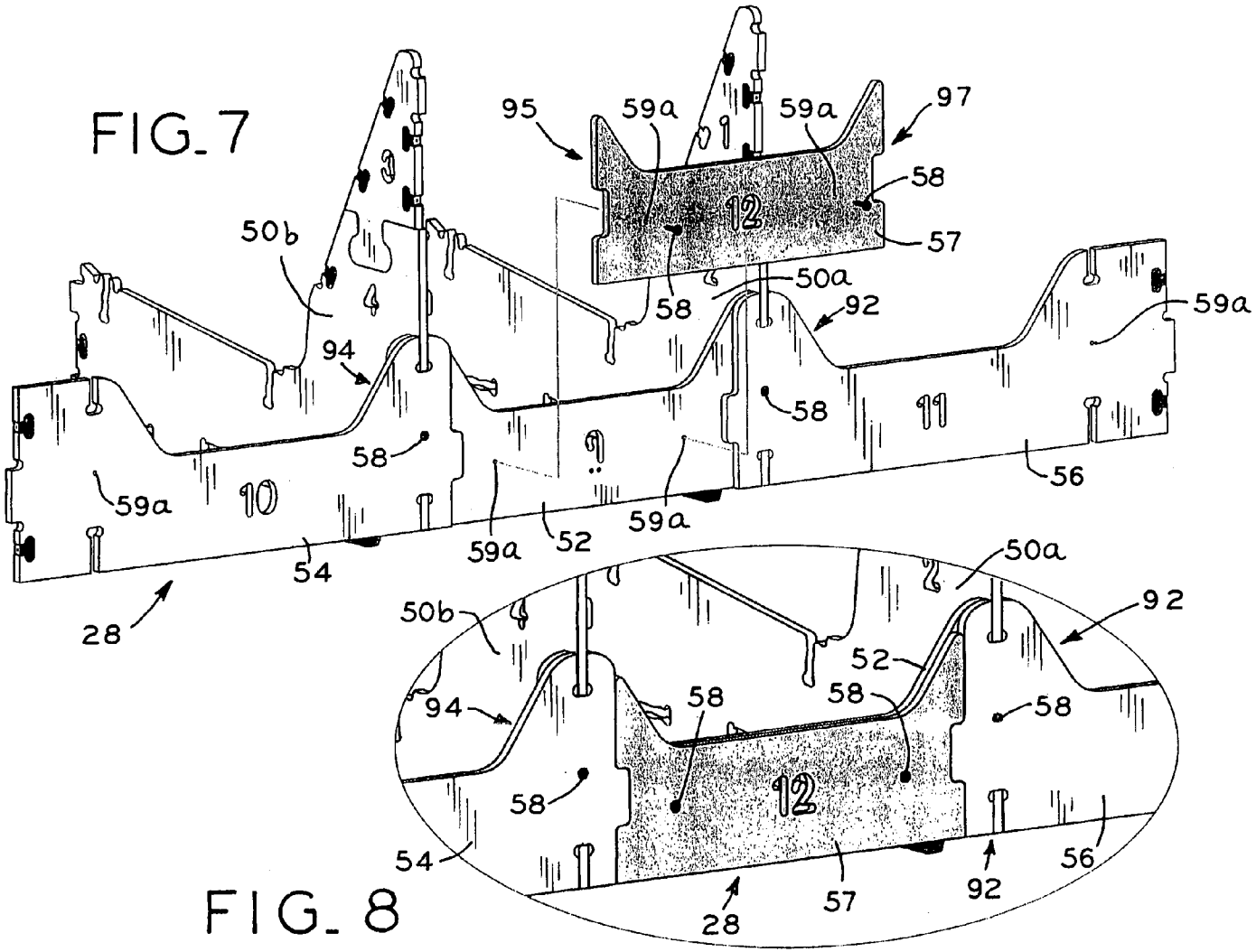
FIG. 7 is an exploded partial perspective view of a portion of the frame of FIG. 3, showing the attachment of an additional planar frame member according to further assembly steps.
FIG. 8 is a perspective view of a portion of the frame of FIG. 7, showing the overlapping portions and the additional planar frame member.

Rear wall 28 is completed with the addition of covering frame member 57, as shown in FIG. 7. Covering frame member 57 includes fastener holes 59*a*. Covering frame member 57 is secured to central frame member 52 via threaded fasteners 58 and end portions 97 and 95 of covering frame member 57 form an interlocking fit with end portions 92 and 94 of end frame members 56 and 54, respectively, whereby covering frame member 57 is flush with end frame members 56 and 54, as shown in FIG. 8.

Figure 9:
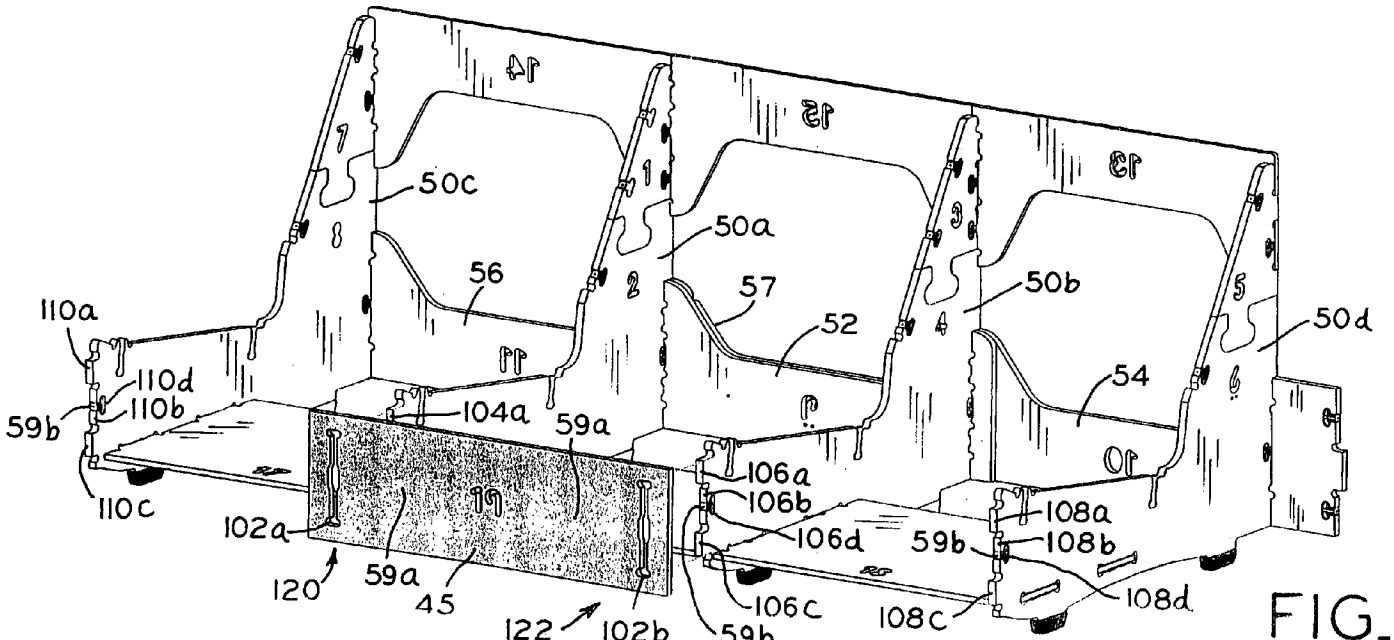
FIG. 9 is an exploded partial perspective view of a portion of the frame of FIG. 2, showing the attachment of individual planar frame members according to additional assembly steps.
Figure 10:
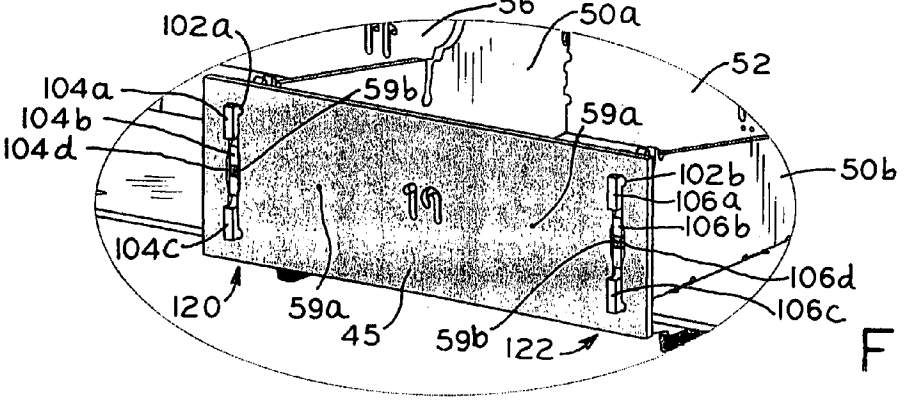
FIG. 10 is a perspective view of a portion of the frame of FIG. 9, showing the interlocking connections of the individual planar frame members.

Referring now to FIG. 9 and describing front wall 22, central frame member 45 includes slots or recesses 102*a* and 102*b* in end portions 120 and 122 thereof. Perpendicular member 50*a* includes protrusions 104*a*, 104*b* and 104*c*, as shown in FIGS. 9 and 10. Protrusion 104*b* of perpendicular member 50*a* includes push-in connector element 104*d* having connector fastener hole 59*b*. Protrusions 104*a*, 104*b* and 104*c* engage with slot 102*a* of central frame member 45, shown in FIG. 10. Perpendicular member 50*b* includes protrusions 106*a*, 106*b* and 106*c*. Protrusion 106*b* includes push-in connector element 106*d* having connector fastener hole 59*b*. Protrusions 106*a*, 106*b* and 106*c* of perpendicular member 50*b* engage with slot 102*b* of central frame member 45, shown in FIG. 10. Protrusions 104*a*, 104*c*, and 106*a*, 106*c* of perpendicular members 50*a* and 50*b*, respectively, extend beyond the planar surface of central frame member 45, while protrusions 104*b* and 106*b* of perpendicular members 50*a* and 50*b*, respectively, are flush with the surface of central frame member 45, as best shown in FIG. 10.

Figures 11, 12:
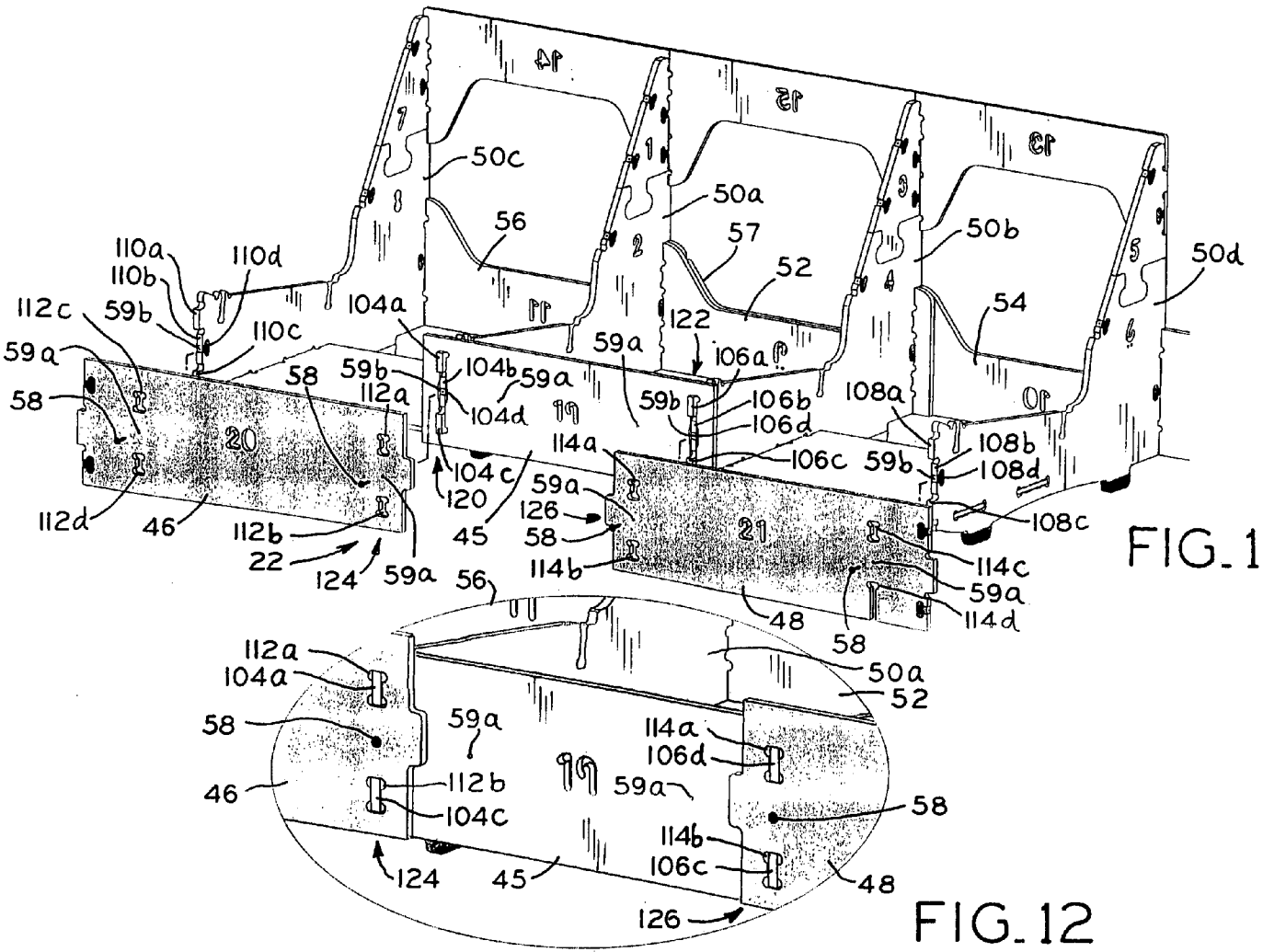
FIG. 11 is an exploded partial perspective view of the frame of FIG. 2, showing the attachment of individual planar frame members according to further assembly steps.
FIG. 12 is a perspective view of a portion of the frame of FIG. 11, showing the interlocking and threaded fastener connections of individual planar frame members.

End frame members 46 and 48 are shown in FIGS. 11 and 12. End frame member 46 includes slots or recesses 112*a*–112*d*, fastener holes 59*a*, and end portion 124, shown in FIG. 11. Protrusions 104*a* and 104*c* of perpendicular member 50*a* engage with slots or recesses 112*a* and 112*b*, respectively, of end frame member 46, thereby providing an interlocking connection. End frame member 46 is further secured to perpendicular member 50*a* via threaded fastener 58 received in connector fastener hole 59*b* of push-in connector element 104*d*, shown in FIG. 12. Perpendicular member 50*c* includes protrusions 110*a*, 110*b* and 110*c*. Protrusion 110*b* includes push-in connector element 110*d* having connector fastener hole 59*b*. Protrusions 110*a* and 110*c* engage with slots 112*c* and 112*d*, respectively, of end frame member 46. End frame member 46 is secured via the interlocking connections of protrusions 110*a* and 110*c* with slots or recesses 112*c* and 112*d*, as well as threaded fastener 58 received in connector fastener hole 59*b* of push-in connector element 110*d*.

Referring further to FIG. 11, end frame member 48 includes slots or recesses 114*a*–114*d*, fastener holes 59*a*, and end portion 126. Protrusions 106*a* and 106*c* of perpendicular member 50*b* engage with slots or recesses 114*a* and 114*b*, respectively, of end frame member 48. End frame member 48 is further secured to perpendicular member 50*b* via threaded fastener 58 received in connector fastener hole 59*b* of push-in connector element 106*d*, shown in FIG. 12. Perpendicular member 50*d* includes protrusions 108*a*, 108*b* and 108*c*. Protrusion 108*b* includes push-in connector element 108*d* having connector fastener hole 59*b*. Protrusions 108*a* and 108*c* engage with slots 114*c* and 114*d*, respectively, of end frame member 48. End frame member 48 is further secured to perpendicular member 50*d* via threaded fastener 58 received in connector fastener hole 59*b* of push-in connector element 108*d*, shown in FIG. 11. The interlocking and overlapping connections formed by end frame members 48 and 46 with central frame member 45 provide longitudinal and torsional stability to frame 21 of article of furniture 20 when fully assembled, which is equivalent to the longitudinal and torsional stability provided by a single long board in a known article of furniture.

Figure 13:
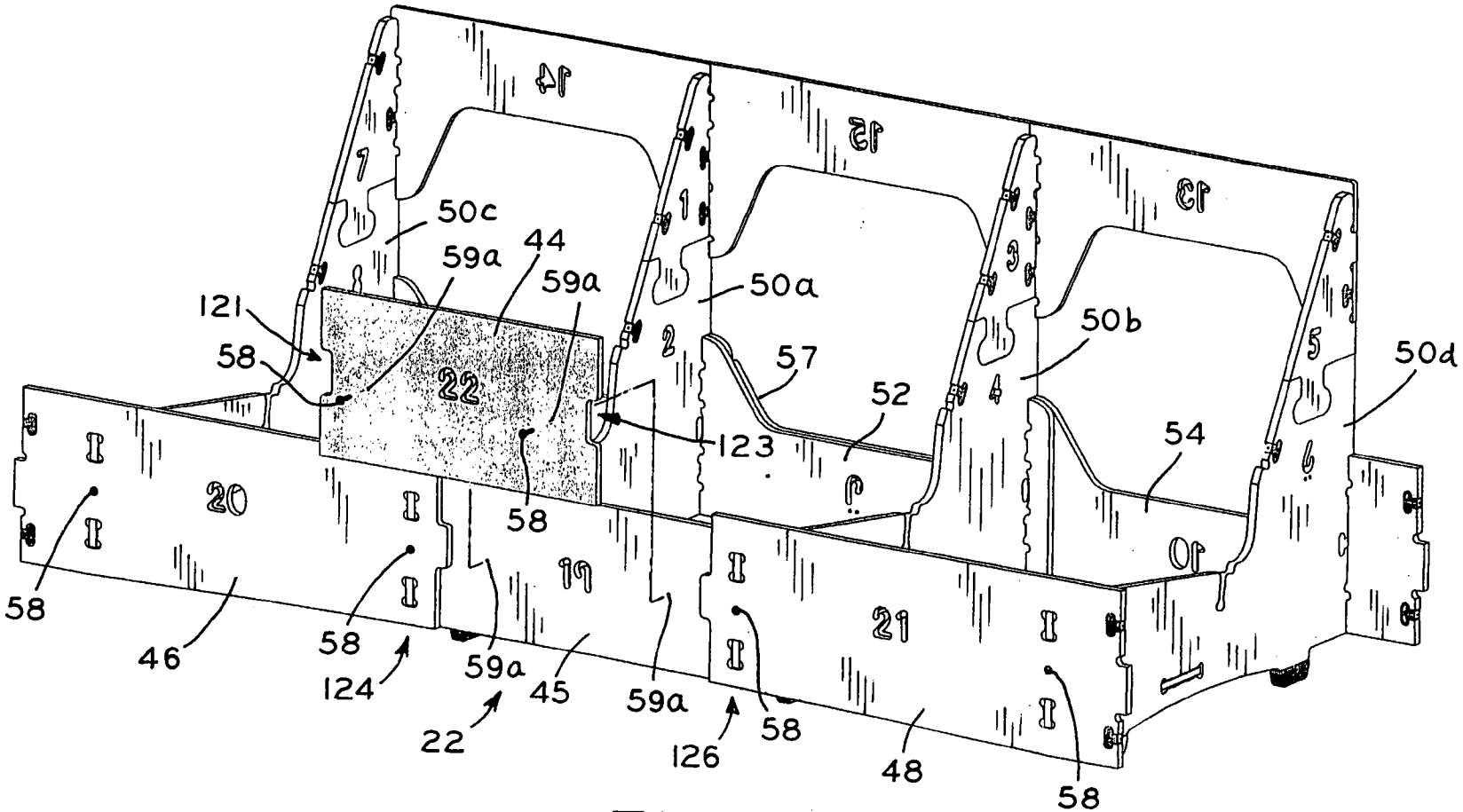
FIG. 13 is an exploded partial perspective view of a portion of the frame of FIG. 2, showing the attachment of an additional planar frame member according to additional assembly steps.

FIG. 13 shows the addition of covering frame member 44 to front wall 22, wherein threaded fasteners 58 are used to secure covering frame member 44 to central frame member 45. End portions 121 and 123 of covering frame member 44 form an interlocking fit with end portions 124 and 126 of end frame members 46 and 48, respectively. Covering frame member 44 is flush with end frame members 46 and 48, thereby providing a uniform surface for covering by upholstery covers (FIG. 1).

Figure 14:
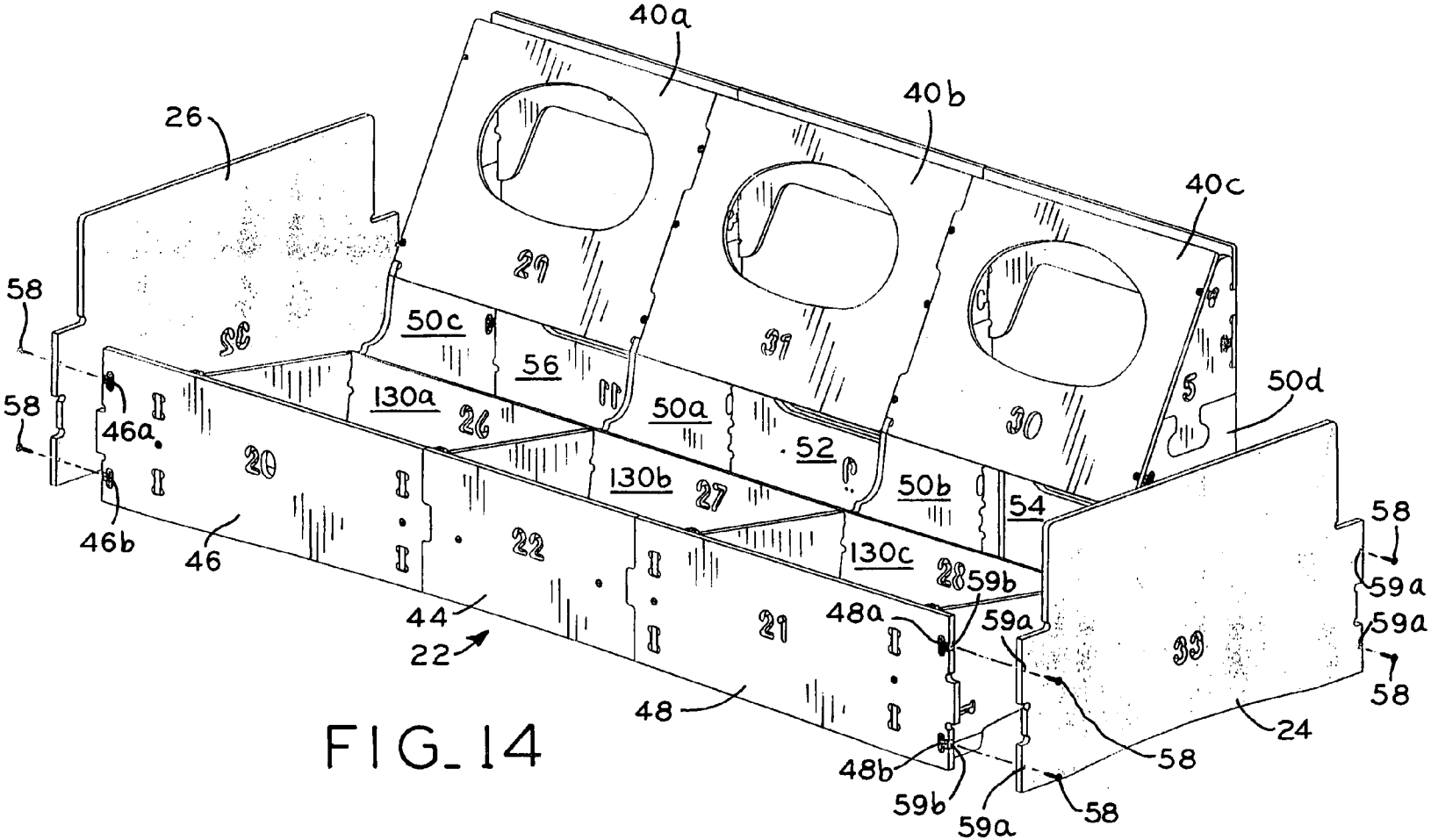
FIG. 14 is an exploded partial perspective view of a portion of the frame of FIG. 2, showing the attachment of individual planar side members.

As shown in FIG. 14, frame members 130*a*, 130*b* and 130*c* provide support for seat portions 42*a*, 42*b* and 42*c* (FIGS. 2 and 3). Furthermore, side wall 24 is secured to end frame members 48 and 54 via threaded fasteners 58 received within push-in connector elements 48*a* and 48*b*, and 54*a* and 54*b* (FIG. 3) and side wall 26 is secured to end frame members 46 and 56 via threaded fasteners 58 received within push-in connector elements 46*a* and 46*b*, and 56*a* and 56*b* (FIG. 3). Push-in connector elements 46*a* and 46*b*, 48*a* and 48*b*, 56*a* and 56*b*, and 54*a* and 54*b*, each include connector fastener holes 59*b*. Side walls 24 and 26 provide support for arm cushions 36*b* and 36*a*, respectively.

Each of the above-described planar frame members are of a suitable size so they may be packaged for non-particularized parcel delivery service as discussed above. The ease of transportation of the shipping packages by merchants or carriers advantageously reduces shipping costs and/or labor. Further, the smaller frame members advantageously allow for compact packaging and gives consumers the option of either receiving home delivery of the furniture by a parcel delivery service, or to easily take the furniture home from a retail location at the time of sale in their own vehicles, rather than requiring them to wait for particularized delivery by the retailer or another carrier.

The number, size and shape of frame members discussed above will vary depending on the article of furniture to be produced. The frame members may be formed of any suitable supporting material, such as pre-finished plywood, oriented strandboard ("OSB"), medium density fiberboard ("MDF"), laminated veneer lumber ("LVL"), solid wood boards, laminated particle board, pre-formed plastic or metal pieces, other varieties of fiber board or strand board, or structural cardboard of honeycombed paperboard. Furthermore, fasteners may not be required for securing the frame members. For example, the interconnection of the frame assembly may instead consist solely of interlocking frame members, or adhesives may be used to join the frame members. The frame members may be prefinished or may consist of unfinished pieces that the consumers may stain and varnish or paint to suit their individual tastes.

The construction and size of the various components of the present invention advantageously provide to consumers ready-to-assemble upholstered furniture of high quality and low cost.

The final steps of construction for article of furniture 20 of FIG. 1 are described in detail in the above-incorporated U.S. Pat. No. 6,568,058. Fabric upholstery covers are draped over frame 21 and secured thereto via hook-and-loop fasteners. Fabric covers are also designed to fit over foam padding elements or pillows made for the various cushions of article of furniture 20. For example, back cushions 30*a* and 30*b* are constructed using a fabric cover fitted over a pillow. In contrast, for example, arm cushions 36*a* and 36*b* are constructed using a fabric cover fitted over a foam pad. The cushions are then placed on upholstered frame 21 in an arrangement, for example, as shown in FIG. 1.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An article of seating furniture, comprising:

a rigid supporting frame including a seat portion, a backrest portion, a front wall, and a rear wall;

at least one of said front wall and said rear wall comprising a composite frame member, said composite frame member including a plurality of separate planar frame members each having an end portion and coupled to one another in an overlapping end to end manner;

said composite frame member including a long dimension, said frame having a width dimension, said long dimension at least twice said width dimension, said frame including a frame member which is disposed perpendicularly to said long dimension and interlockingly connected to at least two of said plurality of frame members; and at least one upholstery component attached to said frame assembly, whereby said article of seating furniture may be disassembled and shipped as a ready-to-assemble article of seating furniture in a container which is substantially shorter than said long dimension.

2. The article of furniture of claim 1, wherein said composite frame member further includes a central frame member, said central frame member having two opposite ends, said end portions overlappingly coupled to respective ones of said two opposite ends.

3. The article of furniture of claim 1, further comprising a plurality of fasteners securing said plurality of frame members to said perpendicularly disposed frame member.

4. The article of furniture of claim 1, wherein at least one of said front wall and said rear wall includes at least three said separate frame members including a central frame member and two end frame members, said central frame member having opposite ends, said two end frame members overlappingly coupled to respective opposite ends of said central frame member.

5. An article of seating furniture, comprising:

a rigid supporting frame, said frame defining a seat portion, and a backrest portion, said frame including a plurality of planar frame walls, one said frame wall comprising a composite frame member having a long dimension, said frame having a width dimension, said long dimension at least twice said width dimension, said composite frame member including at least two frame members, said two frame members each having an end portion, said two end portions coupled to and partially overlapping one another;

at least one upholstery component attached to said frame;

at least one cushion supported by said seat portion of said frame; and a third frame member disposed substantially perpendicularly to said long dimension of said composite frame member, said at least two frame members each having their overlapping end portions interlockingly connected to said third frame member, whereby said article of seating furniture may be disassembled and shipped as a ready-to-assemble article of seating furniture in a container which is substantially shorter than said long dimension.

6. An article of seating furniture, comprising:

a rigid supporting frame including a plurality of planar frame members connected to one another, said frame including a front wall and a rear wall, said frame defining a seat portion and a backrest portion;

at least one of said front wall and said rear wall comprising a composite frame member having a long dimension, said frame having a width dimension, said long dimension at least twice said width dimension, said composite frame member including three said frame members coupled to one another in an end-to-end manner;

said frame including a fourth frame member disposed perpendicularly to said long dimension, at least two of said three frame members interlockingly connected to said fourth frame member;

at least one cushion supported by said seat portion of said frame; and a plurality of upholstery components attached to said frame, whereby said article of seating furniture may be disassembled and shipped as a ready-to-assemble article of seating furniture in a container which is substantially shorter than said long dimension.

7. The article of furniture of claim 6, wherein said three frame members each include an end portion, said end portions of said at least three frame members overlappingly coupled to one another.

8. The article of furniture of claim 6, wherein one of said three frame members comprises a central frame member and two end frame members, said central frame member having opposite ends, said two end frame members overlappingly coupled to respective opposite ends of said central frame member.

9. The article of furniture of claim 6, wherein said three frame members include end portions, said end portions overlappingly coupled to one another and interlockingly connected to said fourth frame member.

10. The article of furniture of claim 9, further comprising a plurality of fasteners securing said three frame members to said fourth frame member.

* * * * *